US008720898B2

(12) United States Patent
Shires

(10) Patent No.: US 8,720,898 B2
(45) Date of Patent: May 13, 2014

(54) SEAL ASSEMBLY AND METHOD

(75) Inventor: Timothy Shires, Sutton Coldfield (GB)

(73) Assignee: IP Consortium Limited, Poole, Dorset (GB)

( * ) Notice: Subject to any disclaimer, the term of this patent is extended or adjusted under 35 U.S.C. 154(b) by 71 days.

(21) Appl. No.: 13/124,355

(22) PCT Filed: Oct. 19, 2009

(86) PCT No.: PCT/GB2009/051403

§ 371 (c)(1),
(2), (4) Date: Apr. 14, 2011

(87) PCT Pub. No.: WO2010/043916

PCT Pub. Date: Apr. 22, 2010

(65) Prior Publication Data

US 2011/0204572 A1 Aug. 25, 2011

(30) Foreign Application Priority Data

Oct. 17, 2008 (GB) ..... 0819072.0
Jun. 30, 2009 (GB) ..... 0911239.2

(51) Int. Cl.
*F16J 15/34* (2006.01)
*F01C 19/10* (2006.01)

(52) U.S. Cl.
USPC ..... 277/306; 277/357

(58) Field of Classification Search
USPC ..... 277/306, 357
See application file for complete search history.

(56) References Cited

U.S. PATENT DOCUMENTS

| | | | | | |
|---|---|---|---|---|---|
| 3,102,518 | A | * | 9/1963 | Anderson | 418/120 |
| 3,127,095 | A | * | 3/1964 | Froede | 418/61.2 |
| 3,131,945 | A | * | 5/1964 | Scherenberg et al. | 277/357 |
| 3,180,563 | A | * | 4/1965 | Jones et al. | 418/61.2 |
| 3,259,390 | A | * | 7/1966 | Sanford | 277/306 |
| 3,496,916 | A | * | 2/1970 | Jones | 418/61.2 |
| 3,796,527 | A | * | 3/1974 | Woodier et al. | 418/115 |
| 3,845,562 | A | * | 11/1974 | Dallas | 33/605 |
| 3,849,037 | A | | 11/1974 | Downs | |
| 3,851,999 | A | * | 12/1974 | Bibbens | 418/142 |
| 3,860,365 | A | * | 1/1975 | Bibbens | 418/61.2 |
| 3,885,799 | A | * | 5/1975 | Bibbens | 277/357 |

(Continued)

FOREIGN PATENT DOCUMENTS

| | | |
|---|---|---|
| FR | 1 328 140 | 5/1963 |
| FR | 1400729 | 6/1964 |
| FR | 1 443 876 | 7/1966 |

OTHER PUBLICATIONS

International Search Report for PCT/GB2009/051403, dated Feb. 16, 2011, 7 pages.

(Continued)

*Primary Examiner* — Gilbert Lee
*Assistant Examiner* — L. Koneru
(74) *Attorney, Agent, or Firm* — Reising Ethington P.C.

(57) ABSTRACT

A corner seal assembly for a rotor of a rotary engine, the assembly comprising a pair of corner seal elements, each seal element of the pair being arranged to provide a seal between the rotor and a respective one of a pair of opposed end faces of the rotary engine, the seals being arranged to be resiliently coupled to one another whereby the seals exert substantially the same force on each one of the pair of opposed end faces.

13 Claims, 9 Drawing Sheets

(56) References Cited

U.S. PATENT DOCUMENTS

| | | | | | |
|---|---|---|---|---|---|
| 3,887,311 | A | * | 6/1975 | Louzecky | 418/113 |
| 3,936,250 | A | | 2/1976 | Mrlik | |
| 3,963,388 | A | | 6/1976 | Goloff | |
| 3,985,478 | A | * | 10/1976 | Weinand | 418/142 |
| 3,998,572 | A | * | 12/1976 | Warrick | 418/142 |
| 3,999,906 | A | * | 12/1976 | Goloff | 418/142 |
| 4,056,338 | A | * | 11/1977 | Eiermann | 418/119 |
| 4,155,685 | A | | 5/1979 | Kunieda et al. | |
| 4,156,586 | A | * | 5/1979 | Morris | 418/113 |
| 4,797,076 | A | * | 1/1989 | Eiermann | 418/142 |
| 4,815,747 | A | * | 3/1989 | Wolford | 277/306 |
| 4,822,262 | A | | 4/1989 | Bando | |
| 5,049,051 | A | | 9/1991 | Keleher | |
| 5,397,224 | A | * | 3/1995 | Bando et al. | 418/142 |
| 7,275,919 | B2 | * | 10/2007 | Atkins | 418/61.2 |
| 7,303,380 | B1 | * | 12/2007 | Atkins et al. | 418/61.2 |
| 7,334,328 | B2 | * | 2/2008 | Uehara et al. | 29/888.3 |
| 2008/0136113 | A1 | * | 6/2008 | Grisar et al. | 277/357 |

OTHER PUBLICATIONS

GB Search Report for Application No. GB0911239.2, dated Oct. 28, 2009, 2 pages.

* cited by examiner

SEAL ASSEMBLY AND METHOD

FIELD OF THE INVENTION

The present invention relates to combustion seals for internal combustion engines. In particular but not exclusively the invention relates to combustion seals for Wankel rotary engines.

BACKGROUND

Rotary engines can provide a number of advantages over reciprocating piston engines including reduced complexity and increased power for a given engine weight.

An example of a known rotary engine 100 of Wankel type is shown in FIG. 1. The engine 100 has a housing 110 and an eccentric shaft 120 that provides a drive output. The eccentric shaft 120 has a shaft portion 120' having a longitudinal axis and an eccentric portion projecting in a substantially radial direction from a longitudinal axis of the shaft portion 120'. The shaft portion 120' is arranged to be generally coaxial with a stationary gear 122 that is provided in a fixed orientation with respect to the housing 110. The stationary gear 122 is arranged to engage a rotor phasing gear 132 of a rotor 130, the rotor 130 being rotatably coupled to the eccentric portion of the eccentric shaft 120.

In use the rotor 130 describes a rotation-translation motion within a cavity 112 formed in the housing 110, the cavity 112 having a trochoidal shape.

In the example of FIG. 1 the rotor phasing gear 132 is an internal gear whilst the stationary gear 122 is an external gear, the eccentric shaft 120 being arranged to rotate three times for each rotation of the rotor 130.

FIG. 2 shows a cross-section of a portion of the rotor 130 showing corner seal elements 150 provided in cut-out portions 131 of the rotor 130. The cut-out portions 131 are provided in each of three corners of each side face 130A of the rotor. Coil spring elements are provided between the corner seal elements and an internal face of the cut-out portion 131, the spring elements being arranged to urge the corner seal elements against a respective end plate (or 'sidewall' or 'end face') 112 of the housing 110. The corner seal elements 150 are arranged to be slidable within the cut-out portions 131.

A tip seal 160 is provided along a side of the rotor at each of three corners 130B of the rotor 130. Each tip seal 160 is provided in a recess 161 formed in the rotor 130. A leaf spring element 162 is arranged to urge the tip seal 160 against the sidewall 112 of the housing 110.

STATEMENT OF THE INVENTION

In a first aspect of the invention there is provided a corner seal assembly for a rotor of a rotary engine, the assembly comprising a pair of corner seal elements, each seal element of the pair being arranged to provide a seal between the rotor and a respective one of a pair of opposed end faces of the rotary engine, the seals being arranged to be resiliently coupled to one another whereby the seals exert substantially the same force on each one of the pair of opposed end faces.

Embodiments of the invention have the advantage that loads exerted on a side of the rotor by the action of the corner seal elements against respective end faces may be arranged to be substantially equal on opposed sides of the rotor. This has the effect that a rate of wear of an engine may be reduced. Furthermore, a smoothness of operation of the engine may be increased due to equalisation of the loads on respective end faces.

Some embodiments of the invention have the advantage that a rotor arranged to receive a corner seal module according to some embodiments of the invention may be formed in a more convenient manner. In some embodiments the rotor may be formed using a more cost effective forming process. In some embodiments the rotor may be formed with improved precision.

Preferably the assembly has a body portion arranged to be provided between the pair of seal elements.

Preferably the body portion is movable along a direction having a component normal to a plane parallel to the end faces of the engine.

In general, the end faces of the engine are substantially parallel to a plane of opposed sides of the rotor. Typically, the rotor is arranged to rotate in a plane parallel to the end faces of the engine.

The body portion may be slidably movable along said direction.

The seal elements may be resiliently coupled to one another by means of the body portion.

Preferably the seal elements are each resiliently coupled to a respective opposed end of the body portion.

Alternatively the seal elements may be directly coupled to one another by means of a seal coupling.

The seal coupling may be arranged to pass through the body portion.

Alternatively or in addition the seal coupling member may be arranged to pass through a portion of the rotor.

The seal coupling may comprise a resilient member, preferably a spring member.

The seal coupling may comprise one or more resilient members.

The seal coupling may further comprise one or more substantially incompressible and substantially inextensible members.

Preferably the assembly is arranged to be coupled to a corner of the rotor.

Preferably the assembly is arranged to be provided in a slot provided in the rotor.

The slot may have a pair of opposed ends provided with openings formed in respective opposed sides of the rotor.

The assembly may further comprise a tip seal assembly arranged to provide a seal between a tip of the rotor and a sidewall of the engine.

In a second aspect of the invention there is provided a unitary module comprising an assembly according to the first aspect of the invention, the module being arranged to be removably attachable to the rotor.

Preferably the module is arranged to be provided in the slot provided in the rotor.

The module may comprise an outer tube member arranged to be inserted into the slot provided in the rotor.

The outer tube member may be provided with an opening along at least a portion of a length thereof.

The opening may be arranged to receive a portion of the tip seal therethrough.

The tube member may be arranged to house at least a portion of the assembly therein.

This has the advantage of simplifying assembly of the rotor.

The tube member may have an opening provided along at least a portion of a length thereof. The opening may be arranged to receive a portion of the tip seal therethrough.

In a third aspect of the invention there is provided a rotary engine having a corner seal assembly according to the first aspect of the invention.

In a fourth aspect of the invention there is provided a rotary engine having a module according to the second aspect of the invention.

In a fifth aspect of the invention there is provided a method of forming a corner seal assembly for a rotor of a rotary engine, comprising: providing a pair of corner seal elements, each corner seal element of the pair being arranged to provide a seal between the rotor and a respective one of a pair of opposed end faces of the rotary engine; resiliently coupling the corner seal elements to one another whereby the seal elements may be arranged to exert substantially the same force on each one of the pair of opposed end faces of the rotary engine.

The method may further comprise the step of providing the rotor; and installing the corner seal assembly in the rotor.

The step of installing the corner seal assembly may comprise the step of forming corner seal cavities at each of three opposed corners of the rotor, the corner seal cavities each being arranged to receive a corner seal element.

The step of forming corner seal cavities may comprise the step of forming cavities arranged to pass from one side of the rotor to the other, the cavities being open at respective opposed sides of the rotor.

Thus a requirement to drill separate holes in opposed sides of the rotor may be eliminated. Alignment of openings in opposed sides of the rotor may therefore be effected substantially automatically.

Preferably the step of forming the cavities comprises the step of forming the cavities by means of a cutting operation.

The cutting operation may comprise the steps of cutting the cavity by means of one selected from amongst a laser cutting operation, a wire cutting operation and a water jet cutting operation.

The method may further comprise the step of providing the corner seal assembly in the form of a unitary module, the pair of corner seals of the corner seal assembly being resiliently coupled to one another.

The step of installing the corner seal assembly in the rotor may comprise the step of inserting the module into one of the corner seal cavities.

The step of providing the pair of corner seals in the form of a unitary module may comprise the step of applying a removable binding medium to the module to prevent separation of one or more components of the module.

The binding medium may comprise one selected from amongst a wax and a plastics material.

The step of inserting the module into one of the corner seal cavities may be followed by the step of removing the binding medium.

Alternatively the step of inserting the module into one of the corner seal cavities may be preceded by the step of removing the binding medium.

The step of removing the binding medium may comprise the step of performing at least one selected from amongst heating and chemical washing of the binding medium.

Some embodiments of the invention have the advantage that the problem of misalignment of respective recesses formed in opposed sides of a rotor within which respective corner seals are arranged to move is substantially eliminated since a single recess may be formed within which both corner seals slide. This has the advantage that a longevity of a rotary engine may be increased due to a reduction in strain on components of the engine.

BRIEF DESCRIPTION OF THE DRAWINGS

Embodiments of the invention will now be described with reference to the accompanying figures in which.

DETAILED DESCRIPTION

Figure 1:
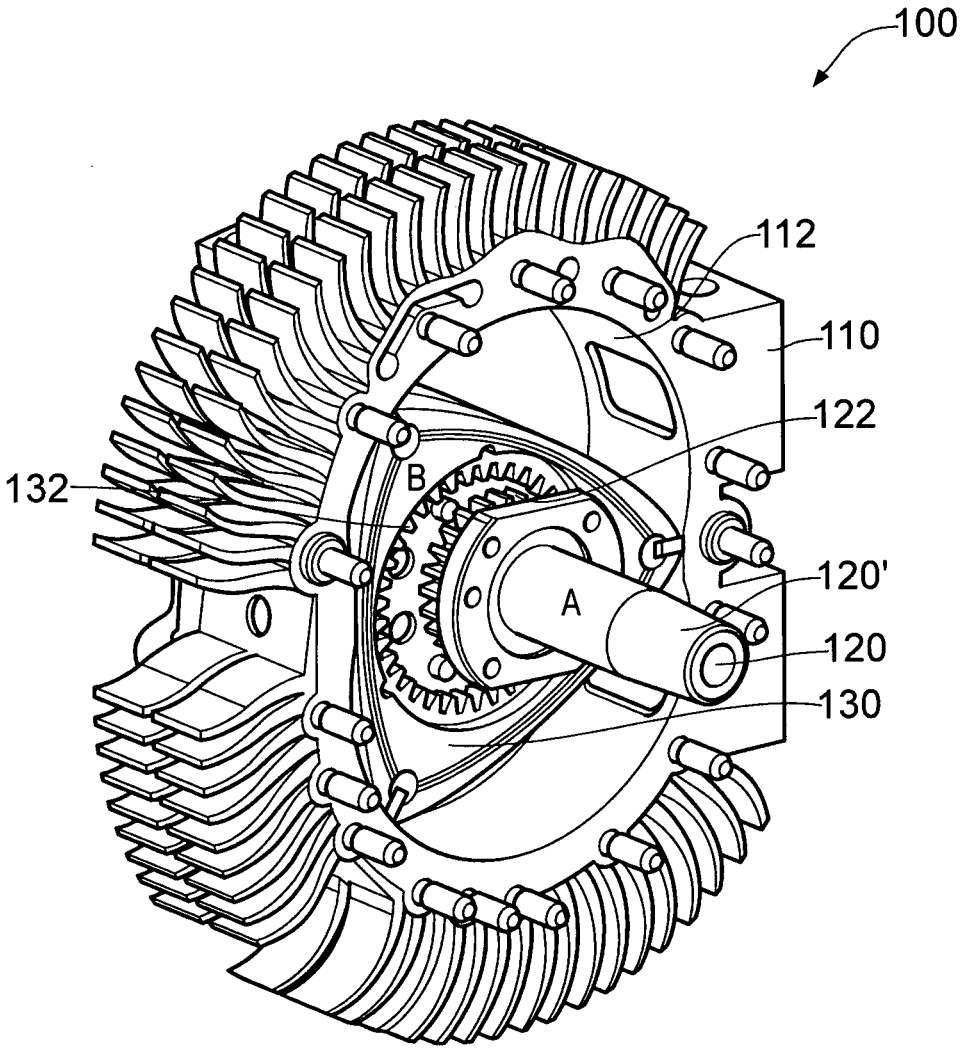
FIG. 1 (Prior Art)
FIG. 1 shows a perspective view of a portion of a prior art Wankel rotary engine.
Figure 2:
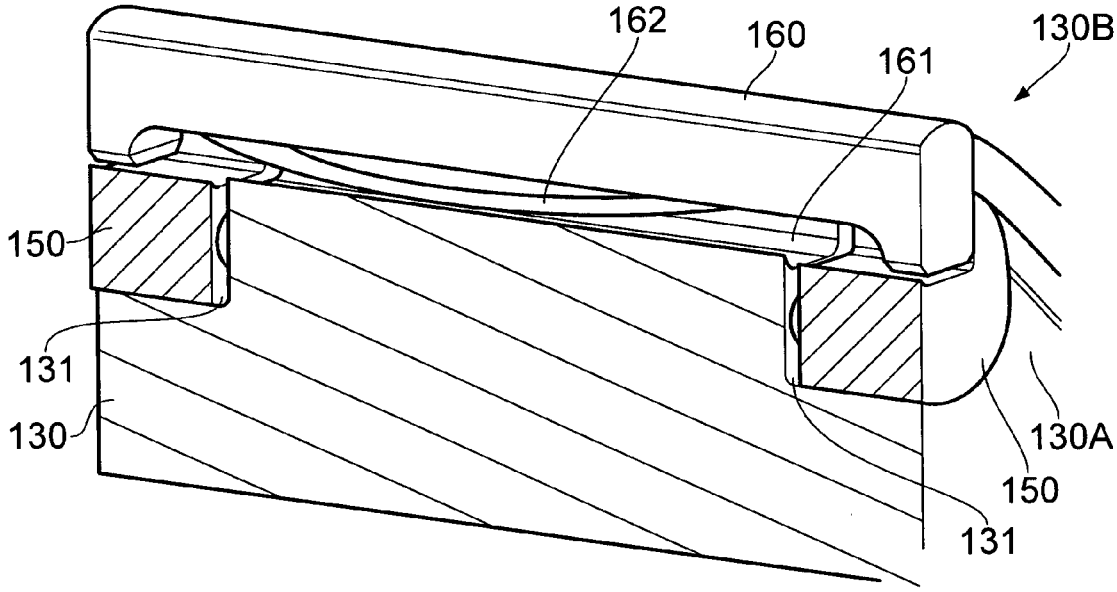
FIG. 2 (Prior Art)
FIG. 2 shows a cross-sectional view of a portion of a rotor of a prior art rotary engine.
Figure 3:
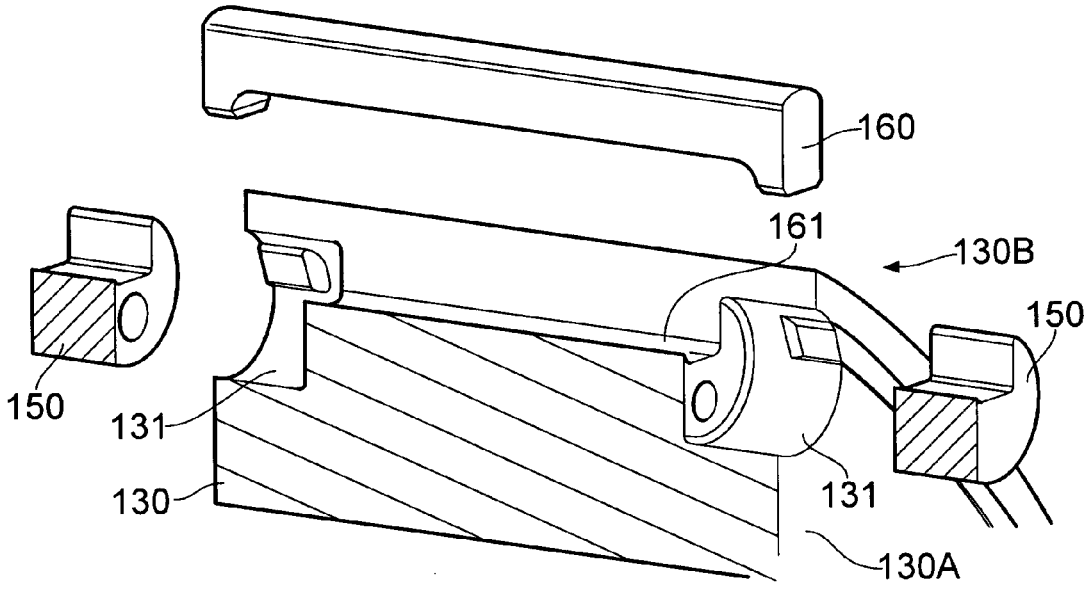
FIG. 3 (Prior Art)
FIG. 3 shows an exploded cross-sectional view of a portion of the rotor of FIG. 2.
Figure 4:
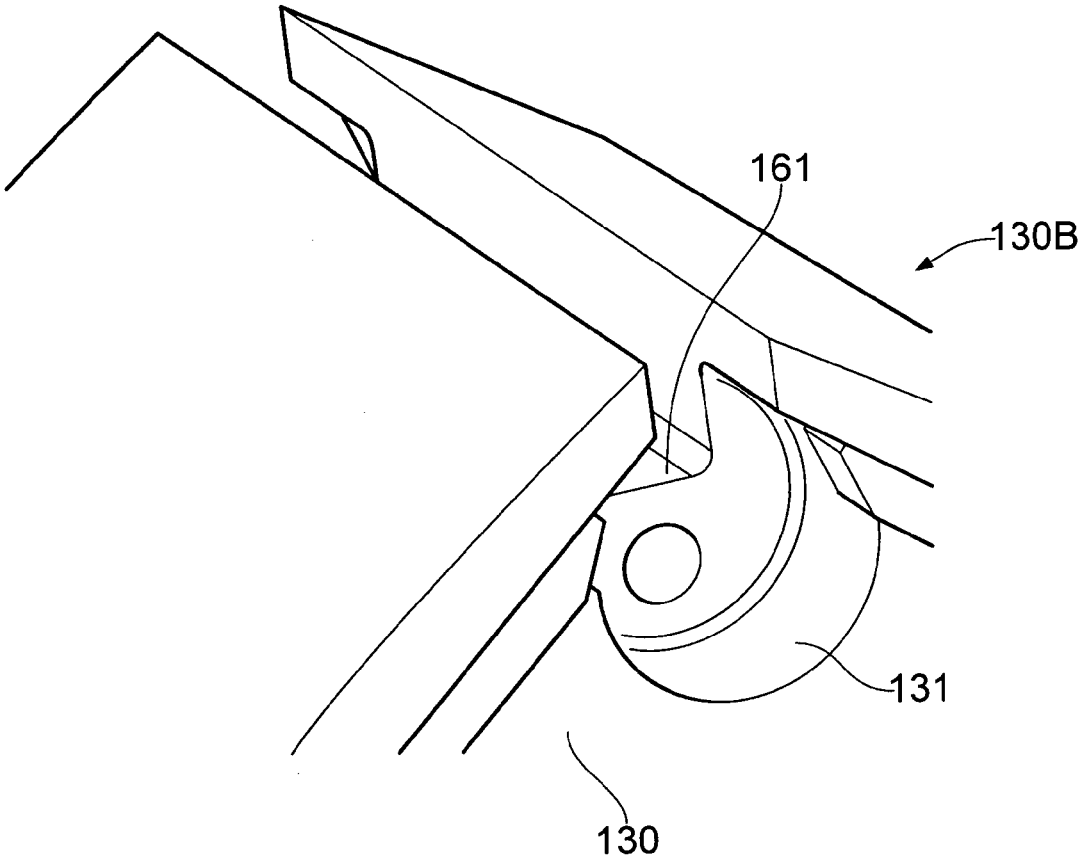
FIG. 4 (Prior Art)
FIG. 4 shows a perspective view of a portion of the rotor of FIG. 2.
Figure 5:
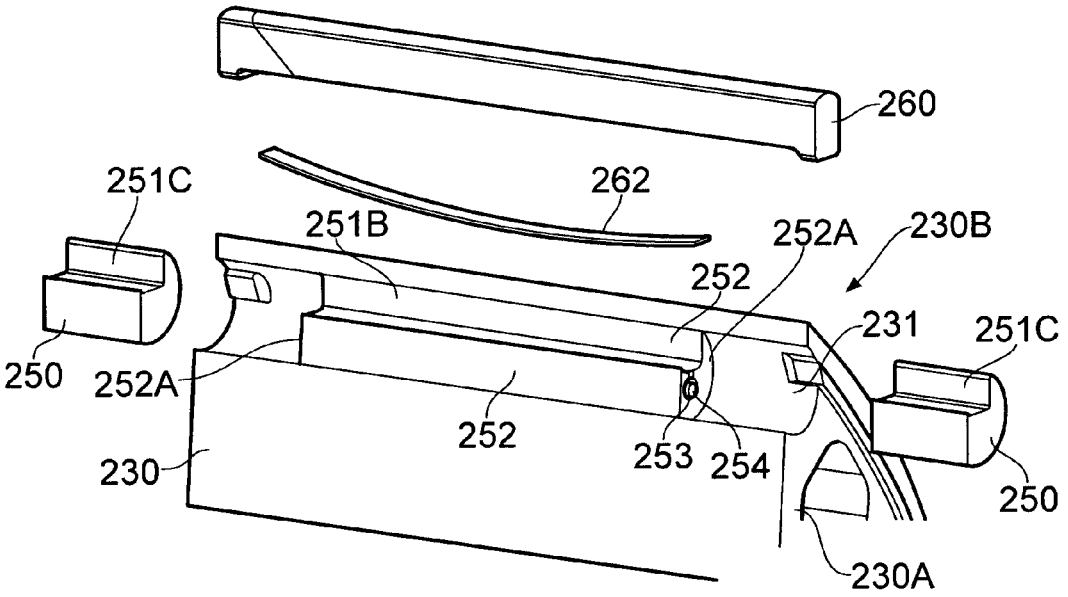
FIG. 5 shows an exploded view of a portion of a rotor according to an embodiment of the invention.

FIG. 5 shows a portion of a rotor 230 formed according to an embodiment of the invention using a wire cutting operation in which a single wire is employed to cut a corner seal recess (or 'slot') 231 in each of three corners 230B of the rotor 230. The corner seal recess 231 may also be referred to as a corner seal cavity 231. Other fabrication methods are also useful such as laser cutting, moulding, casting, milling or other machining or any other suitable method.

The rotor 230 has a corner seal assembly installed therein, the corner seal assembly having a body portion 252 arranged to be provided in the recess 231. In the embodiment of FIG. 5 the body portion has an aperture 253 provided therethrough. Resilient elements 254 (see also FIG. 6) having coil springs provided in cylindrical casings 254C are provided within the aperture 253 and arranged whereby opposed corner seal elements 250 provided in the recess 231 at opposed ends of the recess and on opposite sides of the body portion 252 are resiliently coupled to one another. Thus in some embodiments the body portion 252 does not itself provide a medium through which forces between respective opposed corner seal elements 250 are transmitted.

Figure 6:
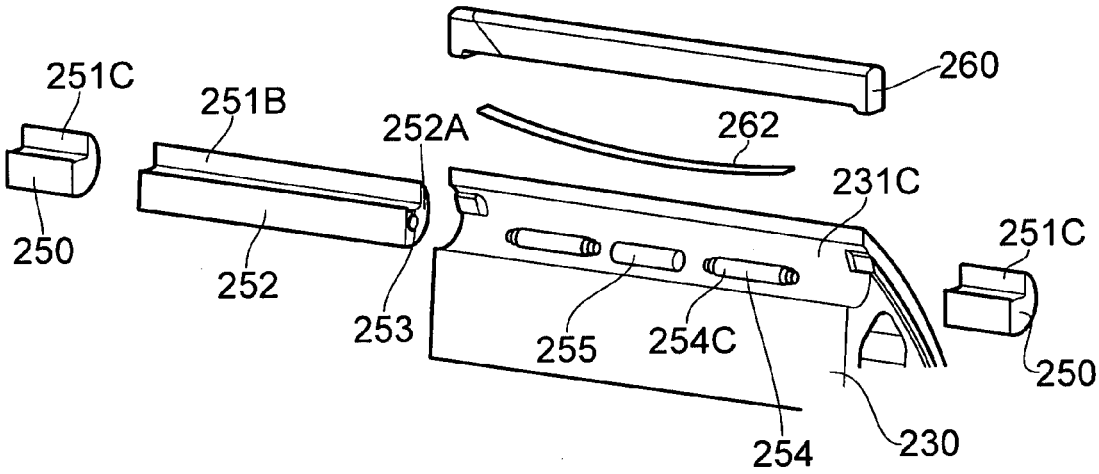
FIG. 6 shows a further exploded view of a portion of a rotor according to an embodiment of the invention.

In some embodiments the resilient elements 254 shown in FIG. 6 are provided by known cartridges for attaching watch straps to a watch body.

In some embodiments each of the resilient elements 254 of FIG. 6 are replaced by a conventional coil spring.

In some embodiments in which the body portion has an aperture 253 formed therethrough a shuttle member 255 (FIG. 6) may be provided within the aperture 253 between a pair of resilient elements 254. The shuttle member 255 is arranged to provide a medium through which forces may be transmitted between respective opposed corner seal elements 250.

In some embodiments the body portion 252 is arranged to be slidable in the recess 231. In some embodiments the corner seal elements 250 are coupled to the body portion 252 by means of resilient coupling elements whereby the body portion effects coupling between the corner seal elements 250. It is to be understood that in such embodiments the body portion itself provides a medium through which forces between respective opposed corner seal elements are transmitted.

In some embodiments of the invention the corner seal elements 250 and body portion 252 are provided with recessed portions 251B, 251C arranged to receive a tip seal 260 and corresponding leaf spring element 262 therein. The recessed portion 251B of the body portion 252 and recessed portion 251C of each of the corner seal elements 250 are arranged to be aligned with one another, providing an open channel facing away from the rotor 230. The leaf spring element 262 is arranged to be provided between the body portion 252 and the tip seal 260.

In some embodiments the tip seal 260 is maintained in a required position within the recessed portions 251B, 251C by entrapment between the rotor and a sidewall of a housing of a rotary engine in which the rotor 230 is provided.

Figure 7:
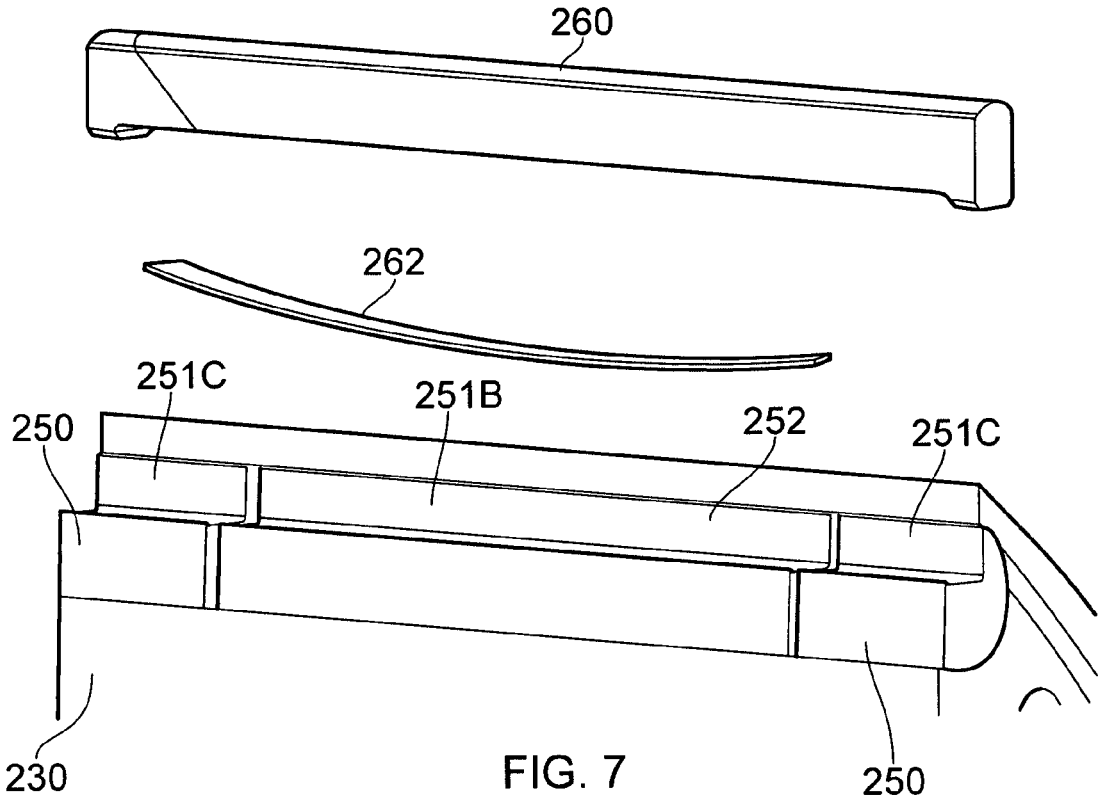
FIG. 7 shows an exploded view of a portion of a rotor according to an embodiment of the invention.

FIG. 7 shows the rotor 230 of FIG. 6 in which the corner seal elements 250 are substantially in the positions assumed when the rotor 230 is in normal use.

Figure 8:
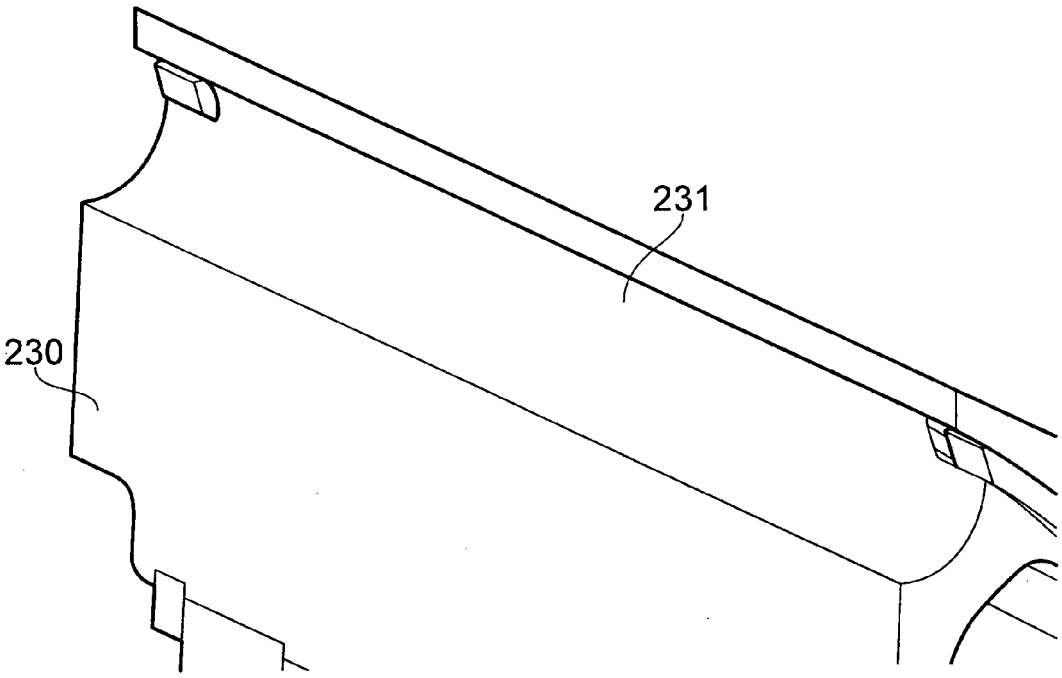
FIG. 8 is a cut-away view of a portion of a rotor according to an embodiment of the invention showing a single recess formed through a corner portion of the rotor.
Figure 9:
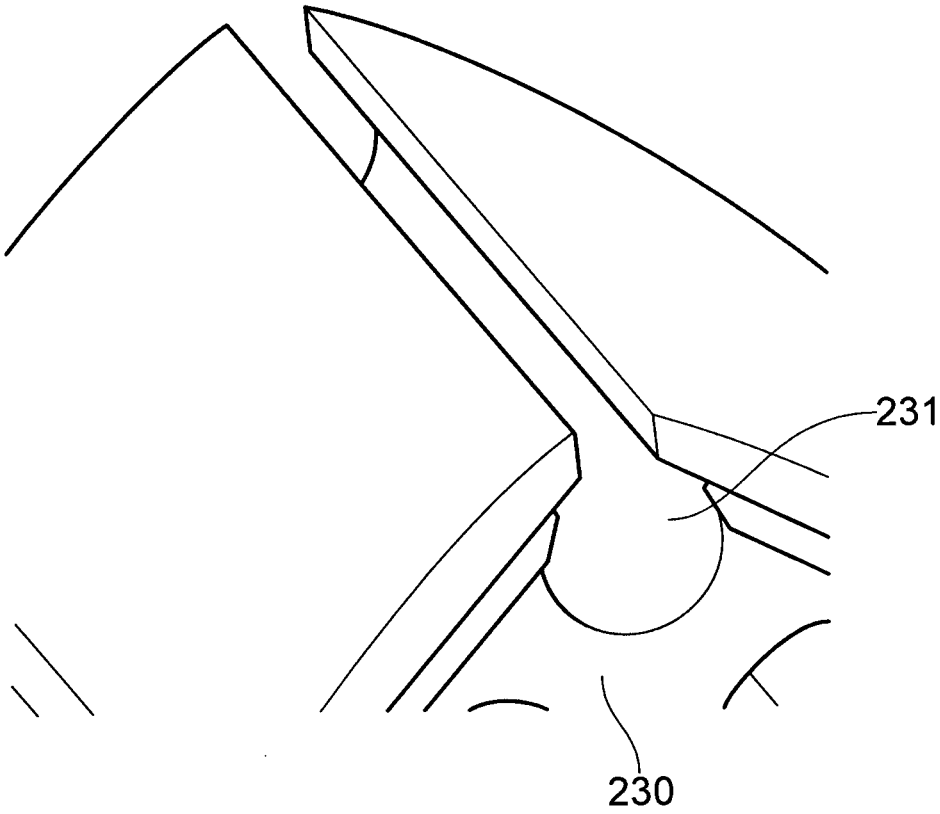
FIG. 9 is a perspective view of a portion of a rotor according to an embodiment of the invention showing a single recess formed through the corner portion of the rotor.

FIGS. 8 and 9 show the rotor 230 of FIG. 7 with the corner seal assembly removed.

In some embodiments of the invention the corner seal assembly is provided in the form of a unitary module or cartridge arranged to be slotted into the corner seal recess 231. In some embodiments the assembly may be provided in a substantially tubular member arranged to be slotted into the corner seal recess 231.

In some embodiments the corner seal assembly and tip seal assembly are provided in the form of a single module that is also arranged to be slotted into a corner seal recess 231. The corner seal assembly may be provided in a substantially tubular member having a slot provided therealong through which at least a portion of a tip seal of the tip seal assembly may be arranged to pass.

The assembly may be supplied in a form in which a binder medium is arranged to maintain components of the assembly in a substantially fixed configuration with respect on one another to aid assembly. The binder medium may be a wax, a plastics material or any other suitable medium that may be removed once the assembly has been delivered to a customer. In some embodiments the binder is arranged to be removed once the assembly has been installed in a rotor.

Throughout the description and claims of this specification, the words "comprise" and "contain" and variations of the words, for example "comprising" and "comprises", means "including but not limited to", and is not intended to (and does not) exclude other moieties, additives, components, integers or steps.

Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith.

The invention claimed is:

1. A rotor and seal assembly for a rotary engine, the assembly comprising a rotor having a slot, the assembly further comprising a pair of corner seal elements, each seal element of the pair being arranged to provide a seal between the rotor and a respective one of a pair of opposed end faces of the rotary engine, the seal elements being arranged to be resiliently coupled to one another whereby the seal elements exert substantially the same force on each one of the pair of opposed end faces;

the assembly further comprising a body element arranged in the slot of the rotor and arranged to be provided between the pair of seal elements, the body element having an aperture there through, the seal elements being directly coupled to one another by means of a seal coupling;

the seal coupling being arranged to pass through the aperture in the body element; and the assembly further comprising a tip seal arranged to provide a seal between a tip of the rotor and a sidewall of the rotary engine; wherein the body portion and corner seal elements are each provided with a recessed portion arranged to receive a portion of the tip seal assembly therein.

2. An assembly as claimed in claim 1 wherein the body element is movable along a direction having a component normal to a plane parallel to the end faces of the engine.

3. An assembly as claimed in claim 2 wherein the body element is slidably movable along said direction.

4. An assembly as claimed in claim 1 wherein the seal coupling is arranged to pass through a portion of the rotor.

5. An assembly as claimed in claim 1 wherein the seal coupling comprises at least one resilient member, preferably at least one spring member.

6. An assembly as claimed in claim 1 wherein the tip seal assembly comprises a tip seal member and a resilient member arranged to be provided between the seal member and the rotor whereby in use the tip seal member may be urged against a sidewall of a rotary engine thereby to provide a seal between the rotor and the sidewall.

7. A unitary module comprising an assembly as claimed in claim 1, the module being arranged to be removably attachable to the rotor.

8. A module as claimed in claim 7 wherein the module comprises an outer tube member containing at least a portion of the corner seal assembly, the tube member being arranged to be inserted into the slot provided in the rotor.

9. A module as claimed in claim 8 wherein the tube member is provided with an opening along at least a portion of a length thereof, the opening being arranged to receive a portion of the tip seal therethrough.

10. A rotary engine having a rotor and seal assembly or a module as claimed in claim 1.

11. A method of forming an assembly for a rotary engine, comprising:

providing a rotor having a slot, providing a pair of corner seal elements, each corner seal element of the pair being arranged to provide a seal between the rotor and a respective one of a pair of opposed end faces of the rotary engine;

resiliently coupling the corner seal elements to one another whereby the seal elements may be arranged to exert substantially the same force on each one of the pair of opposed end faces of the rotary engine, the method further comprising providing a body element in the slot of the rotor and between the pair of seal elements, the body element having an aperture there through, and coupling the corner seal elements to one another by means of a seal coupling, the method comprising passing the seal coupling through the aperture in the body element, and the method further comprising providing a tip seal arranged to provide a seal between a tip of the rotor and a sidewall of the rotary engine, wherein the body portion and corner seal elements are each provided with a recessed portion arranged to receive a portion of the tip seal assembly therein.

12. A rotary engine as claimed in claim 10 wherein the assembly or the module is arranged to be provided in the slot provided in the rotor.

13. A rotary engine as claimed in claim 12, wherein the slot has a pair of opposed ends, the opposed ends being provided with openings formed in respective opposed sides of the rotor.

* * * * *